US005890869A

United States Patent [19]

LeMaster et al.

[11] Patent Number: 5,890,869

[45] Date of Patent: Apr. 6, 1999

[54] WHEELCHAIR TILTING APPARATUS

[76] Inventors: Ronald T. LeMaster, 13217 NE. 59th, #89, Vancouver, Wash. 98682; Terrence S. LeMaster, 730 NE. 100th Ave., #12, Vancouver, Wash. 98662; Timothy A. LeMaster, 5240 N. Oberlin St., Portland, Oreg. 97203

[21] Appl. No.: 61,669

[22] Filed: Apr. 16, 1998

Related U.S. Application Data

[60] Provisional application No. 60/045,240 Apr. 17, 1997.

[51] Int. Cl.[6] ..... A61G 5/00

[52] U.S. Cl. ..... 414/678; 414/743; 414/921

[58] Field of Search ..... 297/DIG. 4, DIG. 10; 414/678, 743, 921

[56] References Cited

U.S. PATENT DOCUMENTS

| | | | |
|---|---|---|---|
| 4,192,549 | 3/1980 | Petresen | 297/DIG. 4 |
| 4,527,944 | 7/1985 | Qually et al. | 414/921 X |
| 4,725,188 | 2/1988 | Zimmermann et al. | 414/921 X |
| 4,790,716 | 12/1988 | McConnell | 414/921 X |
| 4,941,799 | 7/1990 | Gordon et al. | 414/921 X |
| 5,040,939 | 8/1991 | Booth | 414/921 X |
| 5,421,693 | 6/1995 | Petersen | 414/921 X |
| 5,472,307 | 12/1995 | Kadlec et al. | 414/921 X |

*Primary Examiner*—Janice L. Krizek
*Attorney, Agent, or Firm*—Olson and Olson

[57] ABSTRACT

An apparatus is provided for receiving a wheelchair and its seated occupant and tilting the wheelchair rearwardly into a position in which the seated occupant is disposed in a substantially reclined, supported condition for therapeutic and other advantageous reasons. To accomplish this, the wheelchair tilting apparatus utilizes a base frame arranged for placement on a ground surface, the base frame pivotally mounting the rear end of a wheelchair supporting tilt frame assembly having an upstanding backrest member arranged to support the chair and occupant reclined thereagainst when the apparatus is in operative, tilted condition.

7 Claims, 3 Drawing Sheets

WHEELCHAIR TILTING APPARATUS

This application claims the benefit of the priority filing date of U.S. Provisional Application Ser. No. 60/045,240, filed 17 Apr., 1997.

BACKGROUND OF THE INVENTION

The present invention relates to wheelchair tilting devices, and more particularly to an improved and fully patient-operable, therapeutic and patient care wheelchair tilting apparatus arranged to receive an occupied wheelchair and safely move it and its occupant into a desired, tilted, substantially reclining position for purposes which will be explained and become clear herein, and thence to return the wheelchair and its occupant to its upright, original condition afterwards.

As is well known and understood by medical experts and by those who are for a wide variety of reasons, wheelchair bound, the human body is simply not designed for prolonged and continuous periods in a sedentary, sitting position. Proper blood circulation and "pooling" problems throughout the legs and abdomen below the heart are inherent consequences, as well as are pressure sores and restriction of blood supply to the soft tissues of the posterior and undersides of the thighs, and skin breakdown due to sweating combined with a lack of air circulation. Added to these and other medical issues, simple but significant discomfort is an additional and unavoidable consequence for the wheelchair-bound whose condition does not involve the loss of sensation in the lower body and yet are confined to extended periods of time sitting in a wheelchair throughout their waking, active hours.

Proper, basic care of wheelchair-bound patients requires at least the periodic unweighting of the seated body to allow free circulation of blood through the aforementioned soft tissues and necessary, albeit periodic air ventilation of the skin. It is also of medical importance that the patient receives some periodic periods of time in a substantially reclining position such that, since exertive activity is often not possible, the lower body is elevated relative to heart level, usually by transfer to a bed, to enhance circulation issues.

In addition, routine and basic care services to the wheelchair bound are typically encumbered by their disabilities and encumber care providers in even common situations. As examples, dealing with the wheelchair-bound at dentist offices and even hair salons invariably involves awkward patient transfers, often requiring the patient's attendant, from his or her wheelchair to the provider's reclining chair apparatus for dental work, shampoos or other types of procedures.

A need therefore exists for an apparatus particularly adapted for use in hospitals, rehabilitation centers, dentist offices, doctor's offices, patient homes and other locations which is arranged to safely and reliably position a wheelchair-bound patient in desired, reclined positions while in his or her wheelchair, while at the same time providing a simplified and more convenient and improved construction over the closest prior art device (U.S. Pat. No. 4,192,549 issued 11 Mar., 1980). This prior art teaches a simple cradle unit that is configured to effectively "rock" on an underlying floor surface between first and second positions, moved by a complex roller arm assembly that operates against the floor surface itself, rendering the device inoperable on soft or uneven surfaces such as lawns and such, and undesirable for use on carpeted surfaces and such due to wear damage that results from repeated operation of the device on such surfaces. The present invention is also conveniently collapsible into a more compact condition for easy storage and transport, and also has been examined and approved by insurance and government safety regulatory agencies for provision to and use by the public as a wheelchair tilting device that is specifically arranged for assisted and unassisted operation for or by wheelchair-bound persons for the purpose and in the manner which will be described herein.

SUMMARY OF THE INVENTION

In its basic concept this invention provides a base frame member for disposition on a floor surface, the base frame member pivotally mounting a wheelchair-support platform and associated back support, and a drive unit is arranged to interconnect the base frame and platform assembly to move the platform assembly on its pivot mount on the base frame member between positions in which a wheelchair disposed on the platform is moved from its normal upright position to a substantially fully reclining position, and thence back again.

It is by virtue of the foregoing basic concept that the principal object of this invention is achieved, namely, the provision of a wheelchair tilting apparatus that fulfills the present need in the marketplace.

Another object of this invention is the provision of a wheelchair tilting apparatus of the class described which is arranged specifically to permit operation of the device either by an attendant to the occupant of a wheelchair being tilted or by the wheelchair occupant himself.

Another object of this invention is the provision of a wheelchair tilting apparatus of the class described which is collapsible into a compact form for transport and storage.

Another object of this invention is the provision of a wheelchair tilting apparatus of the class described which includes safety features to ensure the user's safety and security as well as ensuring for the safety of attendants and other persons in the immediate vicinity of the apparatus during its operation.

Still another object of this invention is the provision of a wheelchair tilting apparatus of the class described which is of simplified construction for economical manufacture, purchase and maintenance.

The foregoing and other objects and advantages of the present invention will appear from the following description, taken in connection with the accompanying drawings of a preferred embodiment.

DESCRIPTION OF THE PREFERRED EMBODIMENT

Figure 1:
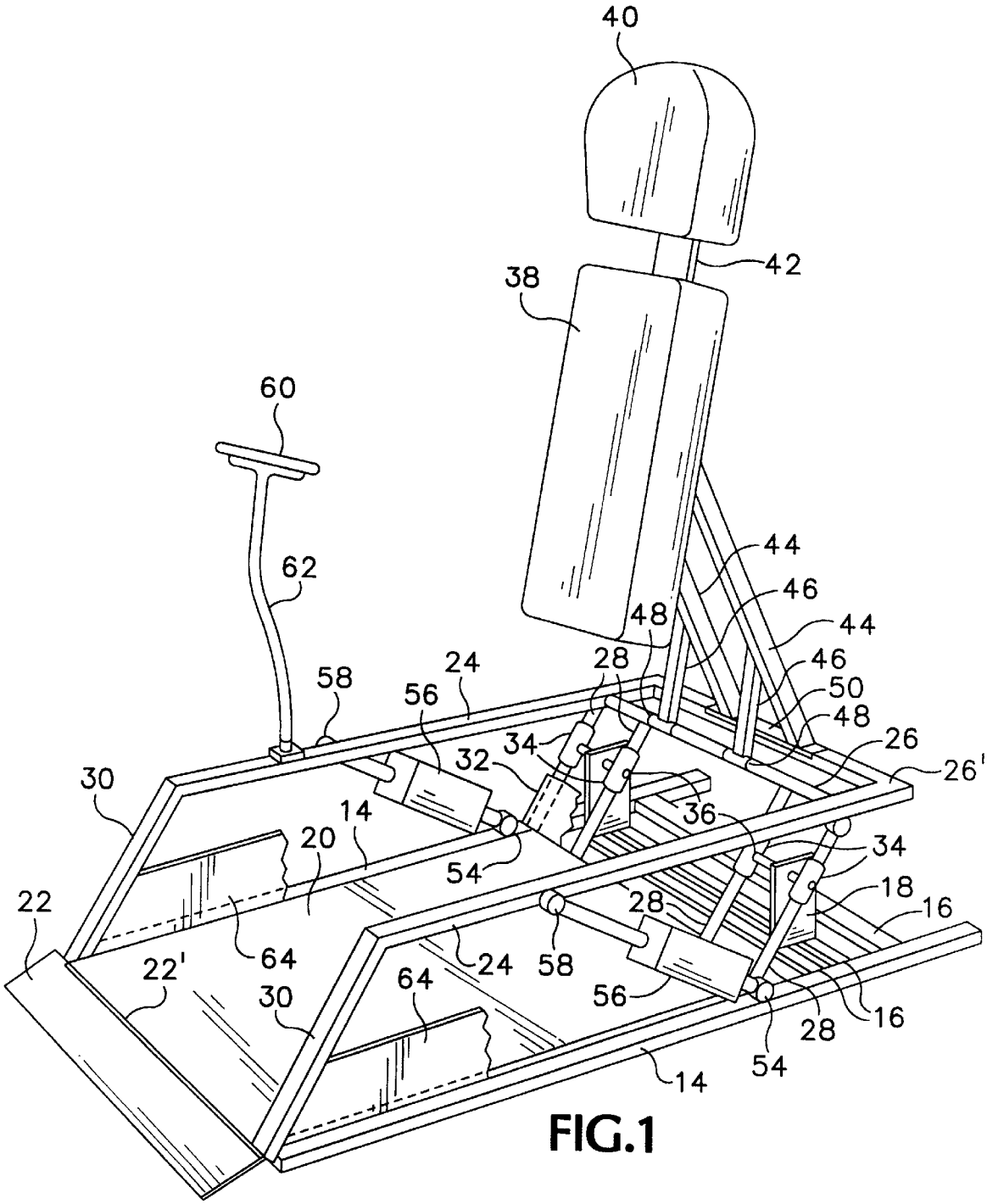
FIG. 1 is a perspective view of a wheelchair tilting apparatus embodying the features of this invention and positioned in an initial position to receive a wheelchair for operation.
Figure 2:
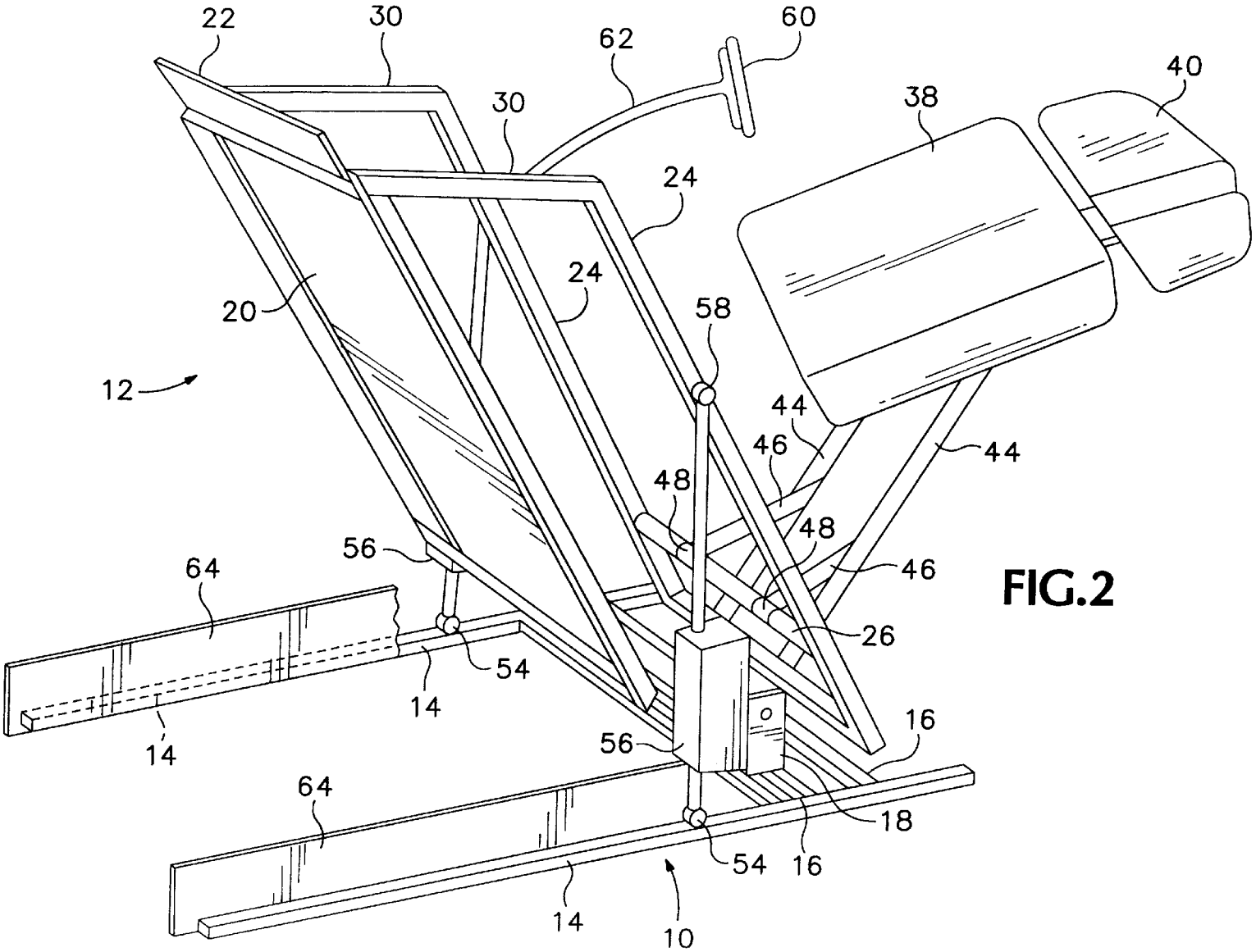
FIG. 2 is a perspective view of the wheelchair tilting apparatus of FIG. 1 in fully reclined, operative condition, the apparatus being illustrated without a wheelchair and its occupant in order to more clearly show features of the apparatus which would otherwise be hidden from view.

As illustrated in FIG. 1, and best identified in FIG. 2 of the drawings, the wheelchair tilting apparatus of this invention comprises a base frame assembly generally indicated at 10 configured for disposition on an underlying floor surface, the base frame pivotally mounting an arcuately movable wheelchair tilt platform frame assembly generally indicated at 12. In the basic embodiment illustrated herein, the base frame 10 comprises a pair of laterally spaced, parallel-extending side rails 14 rigidly secured together in proper condition by laterally extending cross frame members 16 together forming, in this embodiment, a substantially U-shaped framework arranged for stable disposition on an underlying floor surface (not shown). This base framework is preferably configured in the form of tubular or other dimensionally-configured metal stock which is rigidly and securely secured together so as to form an inflexible, rigid framework for support on an underlying surface. The base frame assembly 10 also includes tilt platform mounting means illustrated in the particular embodiment shown as upright frame members 18 secured in this case to base frame cross members 16.

The wheelchair tilting apparatus of this invention includes a wheelchair supporting and tilting assembly 12 which is pivotally mounted at its rearward end portion to the floor supported base frame 10. In the basic embodiment illustrated herein, and best identifiable in view of FIG. 2 of the drawings, the wheelchair supporting and tilt assembly comprises a base wheelchair receiving-and-supporting platform 20 which may include a wheelchair access-facilitating ramp 22 on its forward end if needed or desired. As illustrated, the platform 20 is configured to be contained in the space between the base frame side rails 14, the platform mounting a substantially U-shaped, elevated tilt frame rail assembly having opposite longitudinally extending side rails 24 connected together adjacent their rear ends by laterally-extending cross frame rails 26, 26'. The tilt frame assembly is fixedly secured to the platform 20 by upstanding rear leg members 28 and front leg members 30. The construction formed by the connection of members 20 and 24–30 together results in a strong and rigid wheelchair tilt frame assembly 12. A wheelchair tire stop 32, is provided in this embodiment in the form of a laterally spanning stop plate arranged to provide an abutment to prevent rearward movement of the rear wheels of a wheelchair off of the rearward end of the platform 20.

As shown best in FIG. 1, means is provided to mount the tilt frame assembly 12 pivotally on the base frame assembly 10 for movement of the tilt frame assembly thereon between the upright position of FIG. 1 and the reclining position illustrated in FIG. 2. As seen best in FIG. 1, the rear leg members 28 in this embodiment mount corresponding pivot bracket members 34 which include pivot axles 36 arranged to pivotally engage and be supported by the tilt frame pivot mounts 18 secured to the base frame assembly 10.

The wheelchair tilt apparatus of this invention also includes an upstanding backrest 38 and headrest 40 mounted on and for movement with the tilt frame assembly 12. In the embodiment illustrated, the backrest and headrest frame 42 mounts an angularly extending pair of frame rails 44 each of which in turn mount a downwardly depending support leg 46. These support legs 46 as illustrated preferably terminate in a pivot mount 48 configured to pivotally engage and be supported by cross frame rail 26 whereby the backrest and headrest assembly may be supported on and carried by the tilt frame assembly 12 for pivotal movement thereon between the operative position shown in FIG. 1 and the collapsed, inoperative position shown in FIG. 3. As is apparent, the terminal ends of the frame members 44 mount, in the particular embodiment illustrated, a substantially U-shaped channel member 50 configured to engage, as shown in FIG. 1, the frame cross rail 26' when the backrest assembly is pivoted into its operative, upstanding position relative to the platform 20. Any suitable means may be provided to releasably secure the bracket 50 to the cross member 26'. For simplicity of illustration herein the bracket 50 and the cross rail 26 are provided with aligning bores 52 for use by a pair of bolts and nuts (not shown) which would be adequate for the purpose. In the erected condition illustrated in FIGS. 1 and 2 of the drawings, the backrest assembly is a rigid and strong component of the tilt frame assembly 12 fully capable of supporting the weight of a person and a wheelchair resting thereagainst when in the reclined condition of FIG. 2 of the drawings.

Figure 3:
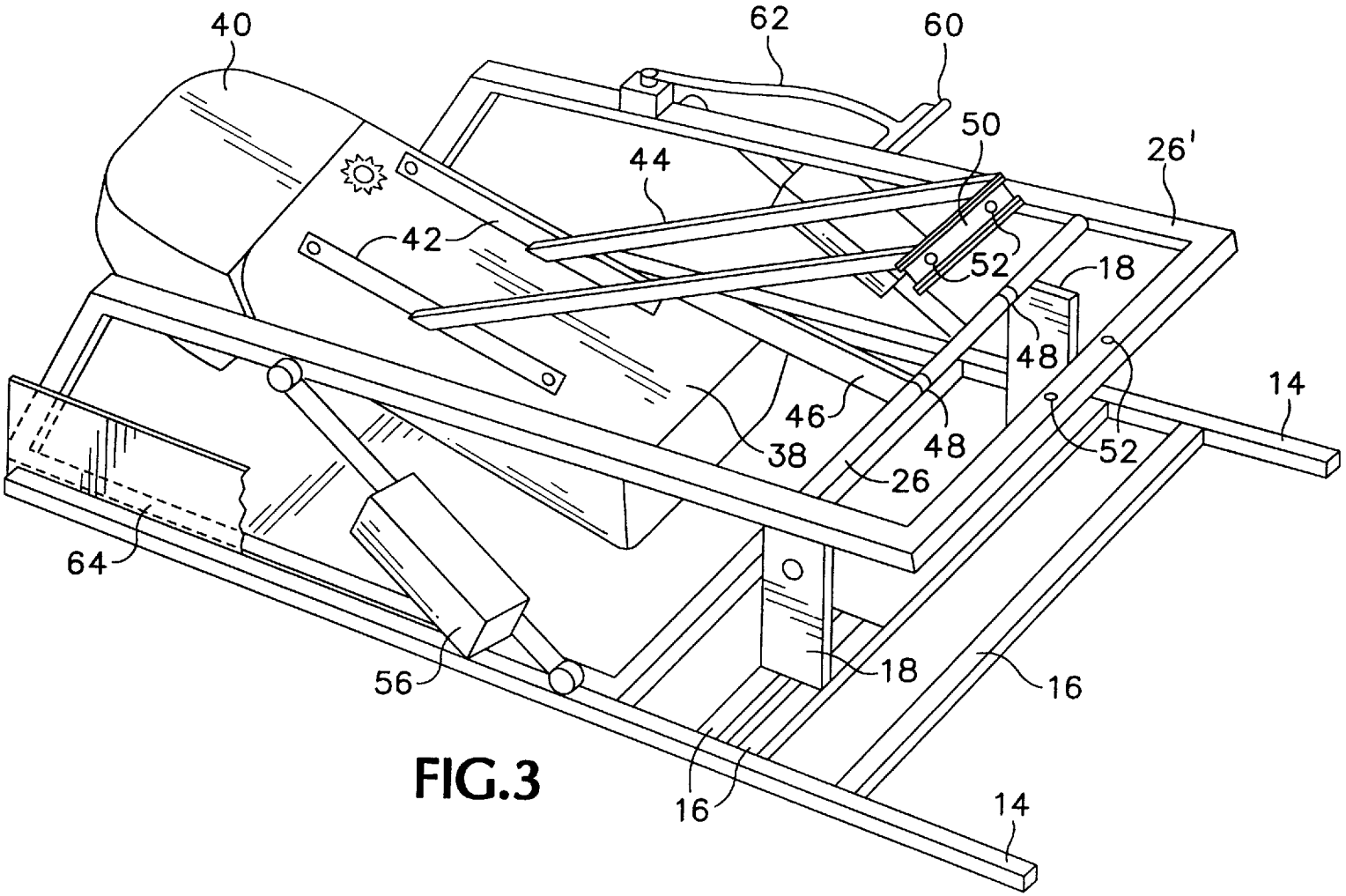
FIG. 3 is a perspective view from a rearward angle showing the apparatus illustrated in FIGS. 1 and 2 in a collapsed, storage or transporting condition with the upstanding backrest assembly and control assembly in inoperative, folded condition whereby a compact, easily erectable assembly is provided when not assembled for use.

Power tilting means is provided on the base frame assembly 10 for engaging the tilt frame assembly 12 and moving the tilt frame assembly arcuately on its pivot mount on the base frame between a first, non-tilted, loading and unloading condition, shown in FIG. 1, and a second, tilted condition pivoted on its supporting pivot mount on the base frame to a desired angular disposition relative to the base frame whereby a wheelchair and its occupant on the platform is tilted into and supported in a desired reclining position such as indicated in FIG. 2, and then when desired, returned to the original upright condition. In the illustrated embodiment of this invention, the base frame 10 mounts a pair of opposite pivot mounts 54 configured to pivotally mount one end of a pair of telescopic drive members 56. The tilt frame side rails 24 mount corresponding pivot mounts 58 for pivotally receiving the opposite ends of the associated telescopic drive members as is readily apparent in the drawings. Operation of the telescopic drive members to extend their telescoping arms moves the tilt frame assembly 12 pivotally on its pivot mount 36 from the condition of FIG. 1 to the condition of FIG. 2, the corresponding required arcuate movement of the drive members 56 being permitted by virtue of their pivotal mounts 54, 58. Operation of the drive members in their opposite direction returns the tilt frame assembly 12 from its position in FIG. 2 to its position of FIG. 1. Preferably, drive member controls (not shown) for operating the drive members are positioned and configured for convenient access and operation by the operator of the device. In this regard, a control unit 60 may be provided on a pivotal arm support member 62 arranged to position the control properly for convenient use by the occupant of the wheelchair. As seen in FIG. 3, the support arm member 62 may, if desired, be pivoted into a collapsed condition for protection of the control unit during storage and transport.

Means is also preferably provided to assure against inadvertent injury or damage that may be caused should a person's foot or other objects move into the position over the base frame side rails 14 during downward movement of the platform into its final lowered condition contained in the space between the base frame side rails 14. Clearly, a person's foot, electrical cords and other objects could be seriously damaged or even crushed under the scissors-like action of the edge of the platform passing by the side rails 14, and therefore a safety means for preventing such occurrence is highly advisable. Such safety means, may, if desired, include any suitable, conventional type of sensor or cutout safety switch arrangement that would immediately stop and/or reverse the drive units, as has long been known with garage door devices and other apparatus having similar safety issues. The simplest such safety means arrangement suitable for the purpose is illustrated herein and provides a simple barrier panel 64 along each base frame side rail 14 to prevent inadvertent movement of feet or other objects into the space occupied by the platform during its travel. Additionally, the ramp 22 may if desired be secured to the front edge of the platform 20 by hinges 22' so that if, in the final descent of the platform a foot or other object is disposed under the ramp 22 as it approaches the floor, its hinge mounting will permit the ramp to pivot upwardly as the platform lowers, thus avoiding crushing injury that may occur if the ramp were fixedly secured to the platform.

The operation of the wheelchair tilting apparatus of this invention is both simple and readily apparent: With the apparatus in the condition of FIG. 1, a wheelchair and its occupant are backed onto the platform and rolled backwards thereon until the rear wheels of the wheelchair abut the tire stop 32. The control unit 60 is operated to operate the telescopic drive members 56 to extend their telescopic arms which in turn moves the tilt frame assembly 12 on its pivot mount on the base frame assembly 10 into a desired position of tilt, such as is illustrated in FIG. 2 of the drawing wherein the occupant of the wheelchair is in a substantially reclining position supported substantially by the backrest and headrest of the apparatus. In this position, much of his weight is removed from his posterior and legs, and the lower part of his body is positioned at a higher level relative to his heart for the aforementioned therapeutic goals. When the user desires, he simply operates the control to reverse the drive members to lower the tilt frame assembly back to its original position whereupon the wheelchair may exit the apparatus.

From the foregoing it will be apparent to those skilled in the art that the disclosure of this invention reveals one embodiment of a satisfactory and workable construction that is entirely suitable for the purpose, but that many various changes other than those already described may be made in the size, shape, type, number and arrangement of parts described hereinbefore without departing from the spirit of our invention and the scope of the appended claims. For example, the drive members 56 are preferably of the screw-drive type for maximum safety. However, hydraulic or pneumatic telescopic cylinders could alternatively be used, as well as any variety of gear-type or other power drive arrangements that may be suitable for the purpose. Also, the particular location of the drive connection between the base frame assembly 10 and the tilt frame assembly 12 as well as the particular type, arrangement and location of the pivot mount of the tilt frame assembly 12 on the base frame assembly 10 and indeed the backrest mounting arrangement illustrated herein are all structural features which may be changed or modified as needed or desired for manufacturing or operational or safety reasons. Accordingly, it is to be understood that the foregoing disclosure is intended to illustrate but a single embodiment of the basic concept of our invention in a simplified but entirely satisfactory condition suitable for our purpose and goals.

Having thus described our invention and the manner in which it is used, I claim:

1. A wheelchair tilting apparatus for receiving a wheelchair and its seated occupant and tilting the wheelchair rearwardly into a supported position in which the occupant of the wheelchair is disposed in a substantially reclined condition in his wheelchair for therapeutic and other purposes, the wheelchair tilting apparatus comprising:

a) a longitudinally-elongated base frame member configured for disposition on an underlying ground surface, the base frame member having front and rear longitudinal ends and spaced apart lateral sides, b) a wheelchair-receiving tilt frame member on the base frame member, the tilt frame member having front and rear ends and spaced apart lateral sides and a wheelchair-supporting platform member, c) interconnecting mounting means on the base frame member and the tilt frame member for securing the members pivotally together for arcuate, rearward tilting movement of the tilt frame member on the base frame member, d) an upstanding backrest member mounted on the tilt frame member and positioned and configured thereon to engage and support the backrest of a wheelchair and the back and head of the occupant of a wheelchair disposed on the tilt frame member platform member in rearwardly tilted, reclined position, said backrest member mounted on the tilt frame member for movement between an operative, locked upright condition to a collapsed, storage condition, and interengaging locking means on the backrest member and the tilt frame member is provided for releasably securing the backrest member in said operative, upright condition e) power drive means engaging the base frame member and the tilt frame member and operable for moving the tilt frame member arcuately on the base frame member between an initial, lowered position in which the platform member is disposed substantially horizontally over an underlying ground surface for entry and exit of a wheelchair, and an operative, rearwardly-tilted position in which the seated occupant of a wheelchair on the tilt frame member is disposed in a substantially reclined position supported by the backrest member, and f) drive control means on the wheelchair tilting apparatus for selectively operating the drive means to move the tilt frame member between said initial and tilted positions.

2. The wheelchair tilting apparatus of claim 1 including safety means associated with the base frame member and the tilt frame member for preventing crushing contact between the tilt frame member and feet and other objects during downward movement of the tilt frame into its said initial, horizontal position.

3. The wheelchair tilting apparatus of claim 1 wherein said power drive means comprises at least one telescoping cylinder unit mounted at one of its ends to the base frame member and at its opposite end to the tilt frame member, whereby extension and retraction operation of the telescoping cylinder unit moves the tilt frame member arcuately on the base frame member.

4. A wheelchair tilting apparatus for receiving a wheelchair and its seated occupant and tilting the wheelchair rearwardly into a supported position in which the occupant of the wheelchair is disposed in a substantially reclined condition in his wheelchair for therapeutic and other purposes, the wheelchair tilting apparatus comprising:

a) a longitudinally-elongated base frame member configured for disposition on an underlying ground surface, the base frame member having front and rear longitudinal ends and spaced apart lateral sides, b) a wheelchair-receiving tilt frame member on the base frame member, the tilt frame member having front and rear ends and spaced apart lateral sides and a wheelchair-supporting platform member, c) interconnecting mounting means on the base frame member and the tilt frame member for securing the members pivotally together for arcuate, rearward tilting movement of the tilt frame member on the base frame member, d) an upstanding backrest member mounted on the tilt frame member and positioned and configured thereon to engage and support the backrest of a wheelchair and the back and head of the occupant of a wheelchair disposed on the tilt frame member platform member in rearwardly tilted, reclined position, e) power drive means engaging the base frame member and the tilt frame member and operable for moving the tilt frame member arcuately on the base frame member between an initial, lowered position in which the platform member is disposed substantially horizontally over an underlying ground surface for entry and exit of a wheelchair, and an operative, rearwardly-tilted position in which the seated occupant of a wheelchair on the tilt frame member is disposed in a substantially reclined position supported by the backrest member, f) drive control means on the wheelchair tilting apparatus for selectively operating the drive means to move the tilt frame member between said initial and tilted positions, and g) safety means on the wheelchair tilting apparatus for preventing movement of the tilt frame member into crushing contact with feet and other objects inadvertently disposed in its path during downward movement of the tilt frame member into its said initial, lowered position.

5. The wheelchair tilting apparatus of claim 4 wherein said safety means includes at least one safety barrier panel on the base frame member configured to prevent inadvertent passage of feet and other objects beneath the tilted tilt frame member during downward movement of the latter into its said initial, lowered position.

6. The wheelchair tilting apparatus of claim 4 wherein said safety means includes a ramp member mounted by hinges on the front end of said wheelchair-supporting platform member and configured for upward pivoting movement thereon during downward movement of the tilt frame member and associated platform member upon contact of the ramp member with feet and other objects inadvertently disposed thereunder during the final descent of the tilt frame member to its initial, lowered position.

7. The wheelchair tilting apparatus of claim 4 wherein said backrest member is mounted on the tilt frame member for movement between an operative, locked upright condition to a collapsed, storage condition, and interengaging locking means on the backrest member and tilt frame member is provided for releasably securing the backrest member in said operative, upright condition.

* * * * *